US005236320A

United States Patent [19]

Oishi et al.

[11] Patent Number: 5,236,320

[45] Date of Patent: Aug. 17, 1993

[54] OIL INJECTION TYPE SCREW COMPRESSOR

[75] Inventors: Yuji Oishi; Koji Kishimoto; Nobuyuki Maki, all of Takasago, Japan

[73] Assignee: Kabushiki Kaisha Kobe Seiko Sho, Kobe, Japan

[21] Appl. No.: 914,921

[22] Filed: Jul. 17, 1992

[30] Foreign Application Priority Data

Jul. 18, 1991 [JP] Japan ..... 3-177908

[51] Int. Cl.[5] ..... F01C 21/04

[52] U.S. Cl. ..... 418/84; 418/88; 418/89; 418/97; 418/DIG. 1

[58] Field of Search ..... 418/84, 88, 89, 97, 418/DIG. 1; 417/13, 18

[56] References Cited

U.S. PATENT DOCUMENTS 4,063,855 12/1977 Paul ..... 418/84
4,123,203 10/1978 Kathmann et al. ..... 418/84 X
4,358,247 11/1982 Suzuki et al. ..... 417/13
4,526,523 7/1985 Parker ..... 418/84

*Primary Examiner*—Richard E. Gluck
*Attorney, Agent, or Firm*—Oblon, Spivka, McClelland, Maier & Neustadt

[57] ABSTRACT

An oil injection type screw compressor includes an oil passage for circulating lubricating oil extending from an oil separator disposed in a discharge passage of a compressor main body through an oil cooler, oil filter and oil pump on the downstream side of the oil pump to parts requiring lubricating oil such as rotors, bearings, shaft sealing members within the compressor main body, the compressor comprising pressure switches for detecting a pressure of a suction passage as a low pressure side, and a pressure of the oil passage between the oil filter and the oil pump as a high pressure side, whereby starting the oil pump when the differential pressure between both the detected pressures is not more than the specified value.

1 Claim, 2 Drawing Sheets

OIL INJECTION TYPE SCREW COMPRESSOR

BACKGROUND OF THE INVENTION

1. Field of the Invention

The present invention relates to an oil injection type compressor including means for protecting the compressor when there occurs abnormality in the pressure of lubricating oil.

2. Prior Art of the Invention

There has been well known such an oil injection type screw compressor, as shown in FIG. 2, which includes an oil passage 18 for circulating lubricating oil. The oil passage 18 extends from an oil separator 13 disposed in a discharge passage 12 of a compressor main body 11 through an oil cooler 14, oil filter 15 and oil pump 16 disposed on the downstream side from the oil filter 15 to parts 11*a* requiring lubricating oil such as rotors, bearings, shaft sealing members within the compressor main body 11.

The lubricating oil thus supplied to the parts requiring lubricating oil is discharged together with compressed gas from the compressor main body 11 to the discharge passage 12, and is then separated from the compressed gas by the oil separator 13. The separated compressed gas is fed to the discharge passage 12 extending from the upper portion of the oil separator 13. Meanwhile the separated lubricating oil is cooled by the oil cooler 14, being filtrated by the oil filter 15, and is then supplied by the oil pump 16 or bypassing the oil pump 16 through a check valve 17 to the parts requiring lubricating oil, to be thus circulated thereafter. As for the oil pump 16, it is operated only when oil is initially supplied before starting the compressor main body 11 and also the supplied oil is decreased in its differential pressure during the ordinary operation. In other words, it is not operated during the normal operation.

Also, the conventional compressor is provided with first, second and third differential pressure switches 20, 21 and 22. The first differential pressure switch 20 functions to detect a pressure in an oil passage 18(*a*) between the oil separator 13 and oil cooler 14 as a lower pressure side, and a pressure of an oil passage 18(*b*) between the oil pump 16 and the compressor main body 11 as a higher pressure side. Switch 20 to thereby drives the compressor main body 11 when the detected differential pressure is not less than the specified value. The second differential pressure switch 21 functions to detect a pressure in a suction passage 19 as a lower pressure side, and a pressure in the oil passage 18(*b*) as a higher pressure side, to thereby automatically start the oil pump 16 when the detected differential pressure is not more than the specified value. The third differential pressure switch 22 functions to stop the compressor main body 11 when the detected differential pressure is furthermore decreased.

With the supplied pressure thus secured, the compressor main body 11 is started. In this case, when the above differential pressure becomes abnormally small due to increase in a suction pressure, decrease in a discharge pressure and blocking of the oil filter 15, the second differential pressure switch 21 is operated to start the oil pump 16. When the above differential pressure becomes furthermore abnormally small, the third differential pressure, switch 22 is operated to cause an emergency stop of the compressor main body 11. Accordingly, the compressor main body 11 can secure the differential pressure of the supplied oil.

As mentioned above, the conventional compressor is so constructed as to detect the differential pressure between a pressure of the suction passage 19 and a pressure of the oil passage 18(*b*), and hence to start or manually stop the oil pump 16 based on the detected differential pressure. Consequently, when the oil pump 16 is stopped, the pressure on the discharge side of the oil pump 16 is decreased due to its stoppage, and hence the differential pressure is made smaller as a result of which the oil pump 16 will be re-started. Namely, the above differential pressure is effected by the starting and stoppage of the oil pump 16.

Therefore, the conventional compressor is disadvantageous in that it is required to manually operate the oil pump 16 after confirming the enough recovery of the differential pressure of the supplied oil.

In order to solve the above disadvantage, it may be considered that the switching difference between from on to off and from off to on in the second differential pressure switch 21 is made larger than the pump boosting rate, or one more differential pressure switch is added.

However, the above switching difference cannot be arbitrarily selected and is difficult to be made larger. Also, the addition of the differential pressure switch makes the pressure detecting system complex and expensive.

SUMMARY OF THE INVENTION

It is therefore an object of the present invention to provide an oil injection type screw compressor including differential pressure switches capable of being operated irrespective of the operation or stoppage of the parts to be controlled thereby protecting the compressor when there occurs abnormality in the pressure of lubricating oil.

To achieve the above object, the present invention provides an oil injection type screw compressor including an oil passage for circulating lubricating oil extending from an oil separator disposed in a discharge passage of a compressor main body through an oil cooler, oil filter and oil pump on the downstream side of the oil pump to parts requiring lubricating oil such as rotors, bearings, shaft sealing members within the compressor main body, the compressor comprising pressure switches for detecting a pressure of a suction passage as a low pressure side, and a pressure of the oil passage between the oil filter and the oil pump as a high pressure side, whereby starting the oil pump when the differential pressure between both the detected pressures is not more than the specified value.

BRIEF DESCRIPTION OF THE INVENTION

The above and other objects, features and advantages of the present invention will be more apparent taken in connection with the accompanying drawings, in which:

FIG. 1 is a view showing the whole construction of an oil injection type screw compressor of the present invention; and FIG. 2 is a view showing the whole construction of a conventional oil injection type screw compressor.

DETAILED DESCRIPTION OF THE PREFERRED EMBODIMENTS

Hereinafter one embodiment of the present invention will be described with respect to the accompanying drawings.

Figure 1:
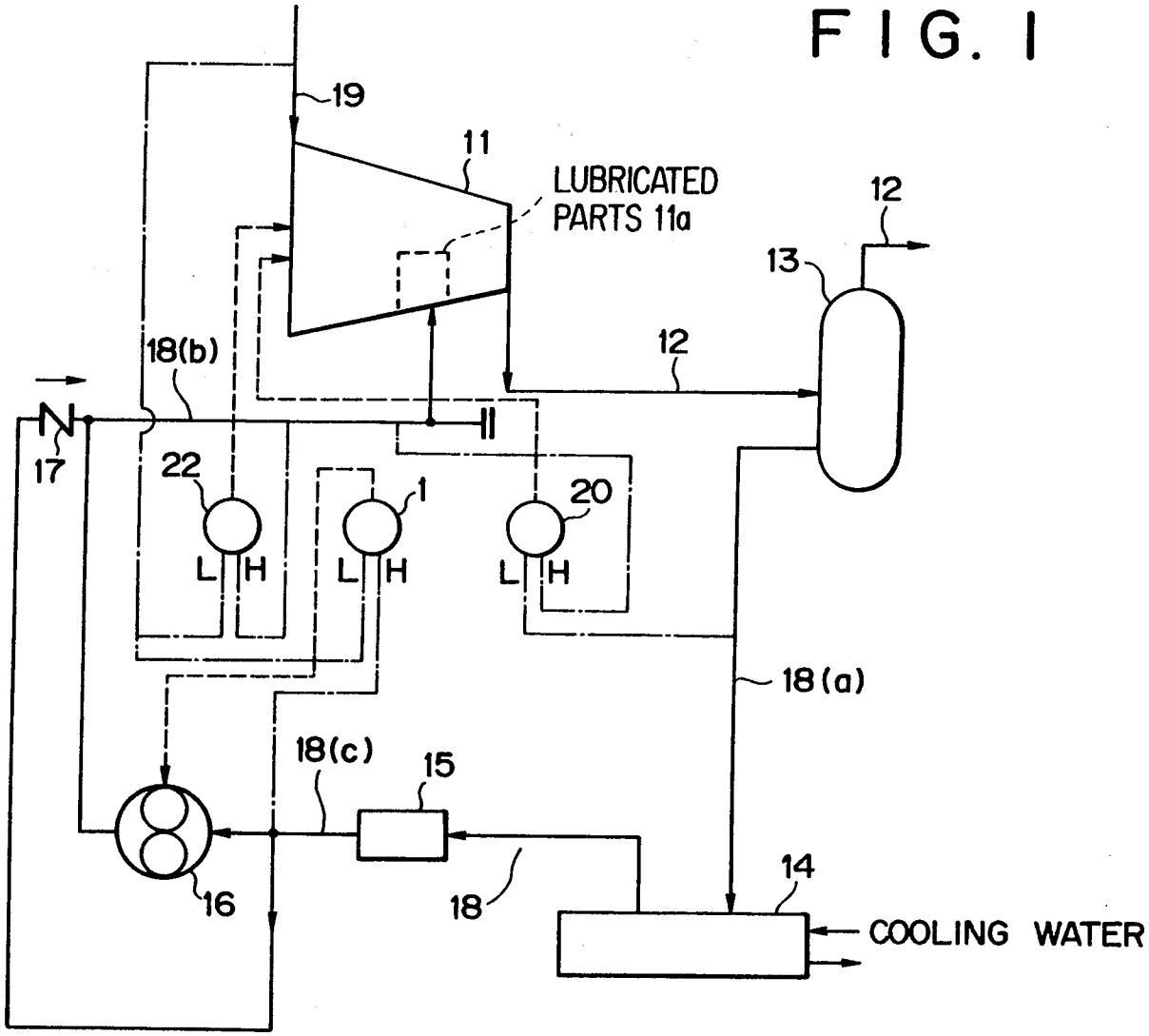
Figure 2:
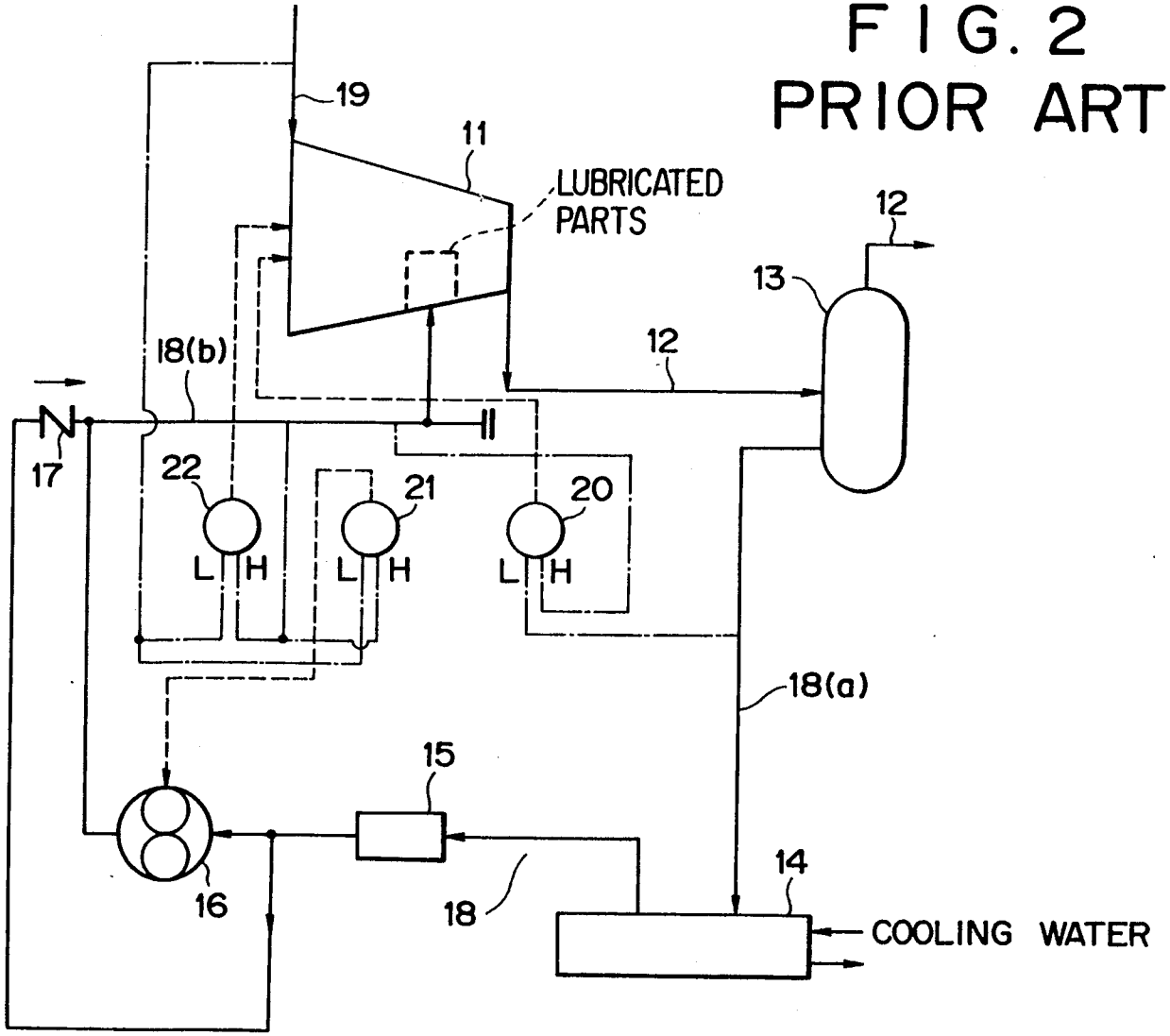
FIG. 2 PRIOR ART

FIG. 1 shows an oil injection type screw compressor of the present invention, wherein the same parts as those of the conventional one shown in FIG. 2 are indicated at the same numerals, respectively. The overlapped explanation thereof is also omitted.

In this embodiment, a second pressure switch 1 is provided in place of the second differential switch 21 of the conventional compressor.

The second pressure switch 1 functions to detect a pressure of a suction passage 19 as a low pressure side, and a pressure of an oil passage 18(*c*) between an oil filter 15 and oil pump 16 as a a high pressure side, and hence to start the oil pump 16 when the differential pressure between both the detected pressures is not more than the specified value.

With the above construction, the differential pressure detected in the second pressure switch 1 is unaffected by operation of the oil pump 16. Namely, after starting the compressor main body 11, the differential pressure between the suction pressure and discharge pressure becomes a specified value or more. Thus, the compressor main body 11 can be operated with the self-oil supply depending on only the thus differential pressure. Even when the pressure of oil supplied to the compressor main body 11 is decreased by manually stopping the oil pump 16, there occurs no effect on the magnitude of the differential pressure in the second pressure switch 1, thereby eliminating the necessity of re-starting the oil pump 16.

Incidentally, in this embodiment, when the second pressure switch lies in a on-state for outputting the starting signal to the oil pump 16, the oil pump 16 is allowed not to be operated. Therefore, by confirming such a state that the manual operation of the oil pump 16 is performable, it is judged that the above differential pressure exceeds the specified value.

Furthermore, during the ordinary operation of the compressor main body 11, the second pressure switch 1 functions to detect blocking of the oil filter 15, decrease in the discharge pressure, and the abnormal decrease in the supplied oil pressure due to increase in the suction pressure, thus automatically re-starting the oil pump 16. Accordingly, the supplied pressure is usually secured at the specified pressure. Meanwhile, even when the differential pressure in the second pressure switch 1 is returned into a normal value to thereby stop the oil pump 16 thereby lowering the pressure of oil supplied to the compressor main body 11, there causes no effect on the magnitude of the differential pressure in the second pressure switch 1. Therefore, the oil pump 16 needs not to be re-started while keeping the pressure of the supplied oil at a normal state.

What is claimed:

1. An oil injection type screw compressor including an oil passage for circulating lubricating oil extending from an oil separator disposed in a discharge passage of a compressor main body through an oil cooler, oil filter and oil pump on the downstream side of said oil filter to parts requiring lubricating oil within said compressor main body, said compressor comprising, pressure switches for detecting a pressure of a suction passage as a low pressure side, and a pressure of said oil passage between said oil filter and said oil pump as a high pressure side, whereby starting said oil pump when the differential pressure between both the detected pressures is not more than the specified value.

* * * * *